US007815752B2

(12) United States Patent
Tanigawa

(10) Patent No.: US 7,815,752 B2
(45) Date of Patent: Oct. 19, 2010

(54) MAGNETIC ALLOY AND METHOD FOR PRODUCING SAME

(75) Inventor: Shigeho Tanigawa, Okegawa (JP)

(73) Assignee: Hitachi Metals, Ltd., Tokyo (JP)

( * ) Notice: Subject to any disclaimer, the term of this patent is extended or adjusted under 35 U.S.C. 154(b) by 379 days.

(21) Appl. No.: 11/910,593

(22) PCT Filed: Apr. 4, 2006

(86) PCT No.: PCT/JP2006/307120

§ 371 (c)(1),
(2), (4) Date: Oct. 3, 2007

(87) PCT Pub. No.: WO2006/107042

PCT Pub. Date: Oct. 12, 2006

(65) Prior Publication Data

US 2009/0194202 A1 Aug. 6, 2009

(30) Foreign Application Priority Data

Apr. 5, 2005 (JP) ..... 2005-108903

(51) Int. Cl.
*H01F 1/055* (2006.01)

(52) U.S. Cl. ..... 148/301; 148/101; 148/122

(58) Field of Classification Search ..... None
See application file for complete search history.

(56) References Cited

U.S. PATENT DOCUMENTS

| | | | | |
|---|---|---|---|---|
| 2004/0194855 | A1 | 10/2004 | Fukamichi et al. | |
| 2004/0231338 | A1* | 11/2004 | Saito et al. | 62/3.1 |
| 2006/0076084 | A1* | 4/2006 | Nakajima | 148/101 |
| 2006/0231163 | A1* | 10/2006 | Hirosawa et al. | 148/105 |

FOREIGN PATENT DOCUMENTS

| | | | |
|---|---|---|---|
| JP | 2002-69596 | A | 3/2002 |
| JP | 2002-356748 | A | 12/2002 |
| JP | 2003-96547 | A | 4/2003 |
| JP | 2000-99928 | A | 4/2004 |
| JP | 2005-113209 | A | 4/2005 |
| WO | 2004/038055 | A1 | 5/2004 |

OTHER PUBLICATIONS

Solid State Physics, vol. 37, (2002), 419.
Metal, vol. 73, (2003), 849.
S. Fujieda, et al.; Giant isotropic magnetostriction of itinerant-electron metamagnetic $La(Fe_{0.88}Si_{0.12})_{13}H_y$ compounds; Applied Physics Letters; vol. 79, No. 5, Jul. 30, 2001; pp. 653-655.
NEDO Research Finding Report for the 14$^{th}$ year of Heisei (last edition) Project ID00A26019a.
XP-001159876, "Itinerant-Electron Metamagnetic Transition and Large Magnetocaloric Effects in $La(Fe_xSi_{1-x})_{13}$ Compounds and Their Hydrides", A. Fujita et al., vol. 67, No. 10, Mar. 1, 2003.
Supplementary European Search Report dated Jun. 30, 2010.

* cited by examiner

*Primary Examiner*—John P Sheehan
(74) *Attorney, Agent, or Firm*—Sughrue Mion, PLLC

(57) ABSTRACT

Disclosed is a novel process for producing an $NaZn_{13}$ magnetic alloy which enables to obtain a magnetic alloy having higher characteristics than ever before. Specifically disclosed is a magnetic alloy represented by the following composition formula: $(La_{1-x}R_x)_a(A_{1-y}TM_y)_bH_cN_d$ (wherein R represents at least one or more elements selected from rare earth elements including Y; A represents Si, or Si and at least one or more elements selected from the group consisting of Al, Ga, Ge and Sn; TM represents Fe, or Fe and at least one or more elements selected from the group consisting of Sc, Ti, V, Cr, Mn, Co, Ni, Cu and Zn; and x, y, a, b, c and d respectively satisfy, in atomic percent, the following relations: $0 \leqq x \leqq 0.2$, $0.75 \leqq y \leqq 0.92$, $5.5 \leqq a \leqq 7.5$, $73 \leqq b \leqq 85$, $1.7 \leqq c \leqq 14$ and $0.07 \leqq d < 5.0$; with unavoidable impurities being included).

7 Claims, 9 Drawing Sheets

(a)

(b)

MAGNETIC ALLOY AND METHOD FOR PRODUCING SAME

TECHNICAL FIELD

The present invention relates to a magnetic material used in magnetic refrigeration, in which chlorofluorocarbon is not used, and more particularly, to a magnetic material used in an efficient refrigerating system for realization of refrigerators, air-conditioners, etc., which make use of a magnetocaloric effect and are free of environmental disruption.

BACKGROUND ART

Presently, the depletion of the ozone layer and global warming are listed as social and environmental problems on a worldwide scale. It is pointed out that chlorofluorocarbon used in refrigerators such as air-conditioners, etc. is responsible for the depletion of the ozone layer, and the abolition of a specified chlorofluorocarbon within the year of 1995 was prescribed in the international conference called in Montreal in 1987. However, a so-called alternative for chlorofluorocarbon, which is recognized to use as a substitute of the specified chlorofluorocarbon, produces an effect of warming several thousands to several tens of thousands times that of carbon dioxide, and became the object of reduction in the Kyoto Convention for prevention of global warming in 1997. In Europe, the future abolition of car-mounting of the alternative for chlorofluorocarbon has already been prescribed. Under such situation, the development of refrigerating and air-conditioning equipment, which is energy-saving and imposes a low environmental load, has become of urgent necessity, and attention begins to be paid to magnetic refrigeration, in which no chlorofluorocarbons are used. Magnetic refrigeration is conventionally made wide use of in obtaining very low temperature. However, practical use has been difficult in the ordinary temperature range because of a large heat capacity due to lattice vibration of a working substance and because of a large energy due to thermal agitation of a magnetic system. A magnetic material being inexpensive and producing a large magnetocaloric effect is needed as a material for magnetic refrigeration at ordinary temperature Gd (gadolinium) having a point of magnetic transformation (Curie temperature) around ordinary temperatures is conventionally known as a material for magnetic refrigeration at ordinary temperature. However, Gd is a rare and expensive metal among rare earth elements and thus is not an industrially practical material. In recent years, attention is paid to a magnetic material which shows metamagnetism transition, as a material for magnetic refrigeration at ordinary temperature, which replaces Gd. A magnetic material for magnetic refrigeration, which shows metamagnetism transition, is a material which undergoes magnetic transformation from paramagnetism to ferromagnetism upon application of a magnetic field around a Curie point, and provides a large magnetization change in a relatively weak magnetic field so that it posses a feature in that a large magnetocaloric change is obtained. $Gd_5Si_2Ge_2$, $Mn(As_{1-x}Sb_x)$, $MnFe(P_{1-x}As_x)$, $La(Fe—Si)_{13}H_x$, etc. are proposed as such magnetic material. Taking material cost, environmental load, safety in manufacturing processes, etc. into consideration, a $La(Fe—Si)_{13}H_x$ alloy among these working substances for magnetic refrigeration at ordinary temperature is thought to be a most promising candidate substance as a practical material. Examination mainly centering on material study is made on the material in universities (see Non-Patent Documents 1 and 2). Also, Patent Documents 1 and 2, etc. describe similar substances for magnetic refrigeration.

$La(Fe—Si)_{13}H_x$, described above, being a material for magnetic refrigeration at ordinary temperature has expanded crystal lattice and raised Curie temperature by interstitially solid-solute hydrogen into $La(Fe—Si)_{13}$ crystal lattice, which has a $NaZn_{13}$ type crystal structure. As an industrial manufacturing method of the material, it is examined to obtain a desired $La(Fe—Si)_{13}H_x$ alloy by beforehand fabricating a single phase $La(Fe—Si)_{13}$ mother alloy and solid-solute hydrogen between lattices through the gas-solid phase reaction (see Non-Patent Document 3). Hydrogen is solid-solute between lattices whereby the material for magnetic refrigeration at ordinary temperature is enlarged in crystal lattice and raised in magnetic transformation temperature to function as a working substance for magnetic refrigeration at ordinary temperature. For this purpose, it is required that hydrogen be uniformly dispersed and solid-solute into $La(Fe—Si)_{13}$ being a mother alloy. Non-Patent Document 4 discloses, as means for solid-solution of hydrogen into a mother alloy, regulation of amount of solid solute hydrogen and control of magnetic transformation temperature by performing storage of hydrogen in high pressured hydrogen to absorb hydrogen up to around saturation, then performing heat treatment in an argon atmosphere, and performing a dehydrogenation processing.

[Patent Document 1] JP-A-2003-96547 ([0035] to [0037])

[Patent Document 2] JP-A-2002-356748 ([0050] to [0057])

[Non-Patent Document 1] Solid State Physics, vol. 37, (2002), 419

[Non-Patent Document 2] METAL, vol. 73, (2003), 849

[Non-Patent Document 3] Appl. Phys. Lett. 79 (2003) 653

[Non-Patent Document 4] NEDO Research Finding Report for the 14th year of Heisei (last edition) Project ID00A26019a

DISCLOSURE OF THE INVENTION

Problem to be Solved by the Invention

Non-Patent Document 4 discloses a problem that the alloy involves distribution in hydrogen concentration and distribution is also generated in Curie temperature reflecting nonuniformity in distribution of hydrogen concentration. As measures for solution of the problem, Non-Patent Document 4 proposes a processing of forming an alloy having a uniform distribution in hydrogen concentration by performing hydrogen absorbing reaction in a low pressured hydrogen atmosphere of 0.02 MPa for a long term. In this processing, uniformity in hydrogen concentration is achieved as shown in a X-ray diffraction diagram of FIG. 12, but there is caused a problem that heat treatment at 543 K for a term as long as 20 hours is needed in order to absorb hydrogen up to x=1 in the composition formula $La(Fe—Si)_{13}H_x$. In order to industrially mass-produce the alloy, there is a need for a processing of uniformly solid-dissolve a predetermined amount of hydrogen into the mother alloy $La(Fe—Si)_{13}$ in a relatively short term. Therefore, it is an object of the invention to develop a novel process for producing a magnetic alloy of $NaZn_{13}$ type and to provide a magnetic alloy having improved properties, which are not found conventionally.

Means for Solving the Problem

As a result of having earnestly examined an industrial method for producing a $La(Fe—Si)_{13}H_x$ alloy having a $NaZn_{13}$ type crystal structure and used as a material for magnetic refrigeration at ordinary temperature, the inventor of the present application has found that a homogeneous alloy, in which a predetermined amount of hydrogen is solid-solute, is obtained in a short term by selecting appropriate reaction temperature, reaction time, and hydrogen concentration in an atmospheric gas, in which hydrogen and nitrogen are coexistent.

The invention provides a magnetic alloy having a crystal structure substantially composed of a single phase of $NaZn_{13}$ structure and represented by the composition formula $(La_{1-x}R_x)_a(A_{1-y}TM_y)_bH_cN_d$, wherein "R" represents at least one or more elements selected from rare earth elements including Y; "A" represents Si, or Si and at least one or more elements selected from the group consisting of Al, Ga, Ge and Sn; "TM" represents Fe, or Fe and at least one or more elements selected from the group consisting of Sc, Ti, V, Cr, Mn, Co, Ni, Cu and Zn; and "x", "y", "a", "b", "c" and "d" satisfy, in atomic percent, the relations: $0 < x < 0.2$, $0.75 < y < 0.92$, $5.5 < a < 7.5$, $73 < b < 85$, $1.7 < c < 14$ and $0.07 < d < 5.0$; with containing unavoidable impurities. The magnetic alloy is ferromagnetic at liquid nitrogen temperature, and ferromagnetic or paramagnetic due to the solid solution of hydrogen and nitrogen at ordinary temperature. Here, the words "a crystal structure substantially composed of a single phase $NaZn_{13}$" indicate that not less than 95% of the structure is composed of the phase of $NaZn_{13}$ structure. A preferable configuration as a working substance for magnetic refrigeration is provided by making the magnetic alloy amorphous or spherical with a particle size being not more than 500 μm.

A specific method of manufacturing the magnetic alloy having a cubic $NaZn_{13}$ type crystal structure is also possible to comprise: melting and casting "A" and "TM" metals being rare earth metals, which are blended in a predetermined composition ratio, by means of high frequency melting or arc melting; subjecting the obtained ingot to solution heat treatment at 1273 to 1423 K to pulverize it to not more than 500 μm, or spraying the molten metal, as melted by high frequency melting, with high pressured inert gas or water to directly obtain powder of not more than 500 μm, or spraying the molten metal onto a rotating roll to directly obtain powder or thin strip. By subjecting the powder or thin strip to solution heat treatment at 1273 to 1423 K, $(La_{1-x}R_x)_1(A_{1-y}TM_y)$ mother metal having a $NaZn_{13}$ type crystal structure is obtained. By subjecting the mother metal thus obtained to heat treatment at 550 to 700 K in a reactant gas including nitrogen and hydrogen for 0.5 to 5 hours, preferably 1 to 3 hours, it is possible to obtain magnetic powder having a uniform hydrogen and nitrogen absorption distribution. A mixed gas of hydrogen and nitrogen, a mixed gas of hydrogen and ammonia, ammonia gas, etc. are preferable as a reactant gas. A further preferable heat treatment temperature is not lower than 573 K but not higher than 673 K, and a further preferable heat treatment temperature is not lower than 550 K but not higher than 650 K.

According to the invention, in order to demonstrate a large magnetic refrigeration effect in a temperature range centering around 300 K, the material composition of the invention has an important meaning. An amount "a" of rare earth elements of less than 5.5 atomic %, or an amount "b" of rare earth elements of more than 85 atomic % is not preferable since rare earth elements are short and thus a ferromagnetic (Fe—Si) phase is precipitated in a reaction product. Also, when the amount "a" is more than 7.5 atomic %, or the amount "b" is less than 73 atomic %, rare earth elements become surplus and a non-magnetic phase, such as $R_2TM_3$, $RTM_2$, etc., which is rich in rare earth elements, or rare earth oxides, etc. are produced in an alloy, so that magnetocaloric effect is decreased after hydrogen storage. When an amount "y" of transition metal is more than 0.92 atomic %, the $NaZn_{13}$ phase becomes unstable, so that the (Fe—Si) phase is precipitated. When the amount "y" is less than 0.75 atomic %, there is caused a problem that magnetocaloric effect is decreased since a saturation magnetization of the magnetic powder is decreased.

When an amount "c" of hydrogen is increased, the crystal lattice is expanded and a magnetic transformation temperature is increased. By controlling the amount "c", it is possible to control a Curie temperature in a range of 245 to 330 K. An amount "d" of nitrogen is essential to the uniformity of an alloy in distribution of hydrogen concentration, and when the amount "d" is less than 0.07 atomic %, the hydrogen distribution becomes nonuniform and the capability of magnetic refrigeration is decreased. Also, the amount "d" of more than 5.0 atomic % is not preferable since the phases of $NaZn_{13}$ structure having a large and different lattice constant are coexistent in an alloy to lead to a decrease in capability of magnetic refrigeration. The amount "d" is preferably in the range of 0.08 to 3.0 atomic %, more preferably in the range of 0.09 to 0.11 atomic %, and still more preferably in the range of 0.09 to 0.11 atomic %.

By controlling partial pressures of hydrogen and nitrogen, reaction time, and temperature, it becomes possible to control an amount of solid-solute hydrogen in an alloy to obtain a homogeneous alloy in a relatively short term. Reaction temperature of above 700 K is not preferable, since hydride becomes thermodynamically unstable and an amount of solid solute nitrogen is rapidly increased, so that "d" becomes more than 0.5. When reaction temperature is lower than 550 K, nitrogen is little solid-solute in an alloy, so that a homogeneous alloy is not obtained. By controlling partial pressures of hydrogen and nitrogen in the temperature range of 550 to 700 K, more preferably 573 to 673 K, a $NaZn_{13}$ type $La(Fe—Si)_{13}H_xN_y$ magnetic alloy, which is uniform in concentration distribution of hydrogen and nitrogen and has a uniform lattice constant, is obtained. Curie temperature of the magnetic alloy thus obtained ranges from 245 K to 330 K, and further from 250 K to 325 K, and can be made use of as a working substance for magnetic refrigeration in the vicinity of ordinary temperature.

Homogeneity of magnetic powder can be determined by measuring a half-width of a specified diffraction line in powder X-ray diffraction and a temperature change in a magnetization-temperature curve. That is, in the case where the concentration distribution of hydrogen and nitrogen is not uniform, the half-width is increased since phases having different lattice constants exist continuously, and also in the case where nitrogen is solid-solute excessively, the diffraction line splits into two peaks since a phase, in which nitrogen is solid-solute selectively, and a phase, in which hydrogen is solid-solute selectively, are separated from each other. In this case, a temperature change in magnetization is such that a temperature change in a magnetization curve, which accompanies a phase change, is decreased in inclination and capability of magnetic refrigeration is considerably decreased, since a Curie temperature of a magnetic phase is varied locally and has a predetermined distribution. The magnetic alloy according to the invention possesses a favorable magnetic refrigeration performance and a diffraction line corresponding to a (531) plane of X-ray diffraction of the phase of $NaZn_{13}$ structure can have a half-width of not more than 0.3 degrees by radian. With the magnetic alloy according to the invention, inclination of temperature change in a magnetization-temperature curve is not more than $-1\ Am^2kg^{-1}K^{-1}$ (that is, an absolute value of the inclination is not less than 1 $Am^2kg^{-1}K^{-1}$) Also, α-Fe in the magnetic alloy can be made not more than 5 Vol %.

According to the invention, a half-width in X-ray diffraction is defined as follows. In powder X-ray diffraction (FIG. 12) measured at an accelerating voltage of 50 kV and an accelerating current of 200 mA with Cu targeted, a width (by a value of 2θ) of a diffraction line in a position corresponding to ½ of a height of a (531) plane peak observed in the vicinity of 47 degrees, which is one of main peaks of $La(Fe.Si)_{13}$ phase, from a base line of the diffraction line, is found as a half-width. As a maximum inclination of a magnetization-temperature curve, a maximum inclination D, that is, $(\Delta M/\Delta T)_{max}$ in a region, in which magnetization rapidly changes, in the magnetization-temperature curve in the range of 77 K (liquid nitrogen temperature) to 323 K measured with an applied magnetic field of 1 kOe, as the $La(Fe.Si)_{13}$ phase undergoes magnetic transformation, is found as in a manner shown in FIG. 13. When distribution (fluctuation) of a Curie temperature is present in a magnetic body, the inclination is decreased. Also, the presence of a ferromagnetic (Fe—Si) phase in large quantity is not favorable since the inclination is decreased.

A part of a rare earth metal La in an alloy can be replaced by lanthanoid element such as Ce, Pr, Nd, Dy, etc. Replacement of not less than 20% is not favorable since a second phase except the phase of $NaZn_{13}$ structure is precipitated. Also, a part of Fe can be also replaced by at least one or more elements selected from the group consisting of Sc, Ti, V, Cr, Mn, Co, Ni, Cu and Zn. These elements are contained in not more than 10 atomic %, because magnetic properties are deteriorated when they exceed 10 atomic % in a total alloy composition.

Furthermore, a part of Si can be replaced by at least one or more elements selected from the group consisting of Al, Ga, Ge and Sn. Controlling of magnetic transformation temperature is made possible according to an amount of the replaced element(s).

According to the invention, in order to demonstrate a magnetic refrigeration effect in a predetermined temperature range, magnetic transformation temperature is controlled. While regulation is made possible according to an added amount of Si, Al, Ge, Sn, etc., it is possible to systematically control the magnetic transformation temperature in a wide temperature range according to the amount of hydrogen and nitrogen.

Advantages of the Invention

According to the invention, a substance for magnetic refrigeration, which is uniform in concentration distribution of hydrogen and nitrogen and in Curie temperature, can be manufactured in large quantity and in a short term, which provides a great industrial meaning.

BEST MODE FOR CARRYING OUT THE INVENTION

The invention will be described by way of embodiments but the invention is not limited to the embodiments.

Embodiment 1

An ingot having a weight of 10 kg and composed of 17.3 mass % (7.2 atomic %) of La, 6.7 mass % (13.8 atomic %) of Si, and the balance of substantially Fe was obtained by melting Fe, Si and La by high frequency melting, and by quenching the molten metal thereof from 1650 K. The ingot comprises a ferromagnetic body composed of (Fe—Si) phase and two La-rich phases and having the composition formula of $La(Fe_{0.85}Si_{0.15})_{12.9}$. The alloy was subjected to solution heat treatment in an argon atmosphere at 1323 K for 250 hours to be made a single phase of $NaZn_{13}$ structure and then pulverized to not more than 500 μm with a disc mill 1 kg of powder was subjected to heat treatment at 623 K in a mixed reactant gas of 1 atmospheric pressure having 60% of hydrogen partial pressure and 40% of ammonia partial pressure for one hour. FIG. 1 shows a X-ray diffraction diagram of powder after reaction. Powder after heat treatment at 623 K has a single phase structure being a substantially cubic $NaZn_{13}$ type crystal structure. A (531) plane being a main diffraction line had a half-width of 0.25 degrees. A Curie temperature was 297 K, and a saturation magnetization was 63 $Am^2/kg$ at liquid nitrogen temperature. Also, a magnetization-temperature curve of the powder in the vicinity of phase transformation shown in FIG. 2 had a maximum inclination of 12.6 $Am^2kg^{-1}K^{-1}$. TABLE 1 indicates amounts of absorbed hydrogen and nitrogen and Curie temperatures of the magnetic powder after heat treatment. TABLE 2 indicates half-widths and maximum inclinations of magnetization-temperature curves, which are found by means of X-ray diffraction.

TABLE 1

| | Reactance gas | Heat Treatment Condition | Amount of Hydrogen (at %) | Amount of Nitrogen (at %) | Curie temperature (K)– |
|---|---|---|---|---|---|
| Example 1 | Hydrogen 60%/Ammonia 40% | 623 K, 1 h | 8.31 | 0.19 | 297 |
| Comparative Example 1-1 | Hydrogen 25%/Argon 75% | 533 K, 0.5 h | 4.13 | 0.02 | 272 |
| Comparative Example 1-2 | Hydrogen 25%/Argon 75% | 533 K, 1 h | 9.00 | 0.04 | 317 |

TABLE 2

| | Reactance gas | Heat Treatment Condition | Half Width | Maximum Inclination |
|---|---|---|---|---|
| Example 1 | Hydrogen 60%/Ammonia 40% | 350° C., 1 h | 0.21 | −2.57 |
| Comparative Example 1-1 | Hydrogen 25%/Argon 75% | 260° C., 0.5 h | 0.46 | −0.31 |
| Comparative Example 1-2 | Hydrogen 25%/Argon 75% | 260° C., 1 h | 0.38 | −0.66 |

COMPARATIVE EXAMPLE 1

FIGS. 14 and 15 show powder X-ray diffraction diagrams of a specimen obtained by subjecting powder, after disc mill pulverization, to heat treatment in a mixed reactant gas composed of 25% of hydrogen gas and 75% of argon gas at 533 K for one hour. FIG. 16 shows changes in magnetization-temperature of specimens obtained by subjecting the same powder to heat treatment at 533 K for 0.5 hours and one hour. It is found that a diffraction lines corresponding to the (531) plane have respectively half-widths of 0.46 and 0.38 degrees. Peaks of the diffraction line split. The diffraction line becomes broad, and phases having different lattice constants are coexistent. Also, maximum inclinations of the magnetization-temperature diagrams were respectively −0.31 and −0.66 $Am^2kg^{-1}K^{-1}$. TABLE 1 indicates amounts of absorbed hydrogen and nitrogen and Curie temperatures of the magnetic powders after heat treatment. TABLE 2 indicates half-widths which are found by means of X-ray diffraction, and maximum inclinations.

Embodiment 2

An ingot having a weight of 10 kg and the same composition as that in Embodiment 1 was produced by high frequency melting. The ingot was subjected to solution heat treatment in an argon atmosphere at 1373 K for 200 hours and then pulverized to not more than 500 μm with a sample mill in the same manner as in Embodiment 1. Each powder having a weight of 1 kg were subjected to heat treatment at 623 K in a hydrogen/ammonia mixed reactant gas of 1 atmospheric pressure for one hour with concentration of ammonia varied in the range of 100 to 20%. Magnetization measurement and X-ray diffraction of the obtained powder were carried out. TABLES 3 and 4 indicate the results. It is found that homogeneous alloy powders were obtained under any of the conditions. FIG. 3 shows magnetization-temperature curves of specimens subjected to heat treatment with concentration of ammonia being 100%, 60%, and 30%. Maximum values of inclinations were respectively −2.38, −2.03 and −2.05 $Am^2kg^{-1}K^{-1}$. Results shown in FIG. 4 were also obtained in examining the relationship between heat treatment temperatures and amounts of hydrogen and nitrogen. Results shown in FIG. 5 were also obtained in examining the relationship between amounts of hydrogen and nitrogen of powders after heat treatment. It is found that Curie temperatures vary linearly in the range of 260 to 360 K relative to the sum (by atomic %) of hydrogen and nitrogen.

TABLE 3

| | Reactance gas | Heat Treatment Condition | Amount of Hydrogen (at %) | Amount of Nitrogen (at %) | Curie temperature (K)– |
|---|---|---|---|---|---|
| Example 2-1 | Ammonia 100% | 623 K, 1 h | 1.3 | 0.47 | 261 |
| Example 2-2 | Hydrogen 20%/Ammonia 80% | 623 K, 1 h | 6.3 | 0.29 | 286 |
| Example 2-3 | Hydrogen 40%/Ammonia 60% | 623 K, 1 h | 10.6 | 0.33 | 289 |
| Example 2-4 | Hydrogen 50%/Ammonia 50% | 623 K, 1 h | 11.2 | 0.24 | 294 |
| Example 2-5 | Hydrogen 60%/Ammonia 40% | 623 K, 1 h | 11.2 | 0.25 | 297 |
| Example 2-6 | Hydrogen 70%/Ammonia 30% | 623 K, 1 h | 12.8 | 0.20 | 302 |
| Example 2-7 | Hydrogen 80%/Ammonia 20% | 623 K, 1 h | 13.4 | 0.18 | 312 |

TABLE 4

| | Reactance gas | Heat Treatment Condition | Half Width (degrees) | Maximum Inclination ($Am^2kg^{-1}K^{-1}$) |
|---|---|---|---|---|
| Example 2-1 | Ammonia 100% | 623 K, 1 h | 0.20 | −2.38 |
| Example 2-2 | Hydrogen 20%/Ammonia 80% | 623 K, 1 h | 0.19 | −1.34 |
| Example 2-3 | Hydrogen 40%/Ammonia 60% | 623 K, 1 h | 0.21 | −2.03 |
| Example 2-4 | Hydrogen 50%/Ammonia 50% | 623 K, 1 h | 0.21 | −2.13 |
| Example 2-5 | Hydrogen 60%/Ammonia 40% | 623 K, 1 h | 0.18 | −2.57 |
| Example 2-6 | Hydrogen 70%/Ammonia 30% | 623 K, 1 h | 0.24 | −2.05 |

TABLE 4-continued

| | Reactance gas | Heat Treatment Condition | Half Width (degrees) | Maximum Inclination ($Am^2kg^{-1}K^{-1}$) |
|---|---|---|---|---|
| Example 2-7 | Hydrogen 80%/Ammonia 20% | 623 K, 1 h | 0.22 | −1.05 |

Embodiment 3

An ingot having a weight of 10 kg and the same composition as that in Embodiment 1 was produced by high frequency melting. The ingot was subjected to solution heat treatment in an argon atmosphere at 1373 K for 200 hours and then pulverized to not more than 500 μm with a sample mill in the same manner as in Embodiment 1. Each powder having a weight of 1 kg were subjected to heat treatment at temperature of 573 to 723 K in a mixed reactant gas of 60% of hydrogen and 40% of ammonia with reaction time varied, and X-ray diffraction (FIGS. 6 and 7) and magnetization measurement of the powder after heat treatment were carried out. Results are indicated in TABLES 5 and 6.

TABLE 5

| | Reactance gas | Heat Treatment Condition | Amount of Hydrogen (at %) | Amount of Nitrogen (at %) | N + H (at %) | Curie temperature (K)– |
|---|---|---|---|---|---|---|
| Example 3-1 | Hydrogen 60%/Ammonia 40% | 573 K, 2 h | 12.7 | 0.13 | 12.83 | 312.5 |
| Example 3-2 | Hydrogen 60%/Ammonia 40% | 623 K, 1 h | 11.2 | 0.25 | 11.45 | 297 |
| Example 3-3 | Hydrogen 60%/Ammonia 40% | 623 K, 2 h | 11.5 | 0.30 | 11.80 | 305 |
| Example 3-4 | Hydrogen 60%/Ammonia 40% | 623 K, 4 h | 12.2 | 0.49 | 12.69 | 298 |
| Example 3-5 | Hydrogen 60%/Ammonia 40% | 673 K, 2 h | 9.2 | 1.19 | 10.39 | 308.7 |
| Example 3-6 | Hydrogen 60%/Ammonia 40% | 673 K, 3 h | 8.4 | 1.39 | 9.79 | 298.2 |
| Comparative Example 3-3 | Hydrogen 60%/Ammonia 40% | 723 K, 3 h | 6.0 | 3.29 | 9.29 | 299.8 |

TABLE 6

| | Reactance gas | Heat Treatment Condition | Half Width (degrees) | Maximum Inclination ($Am^2kg^{-1}K^{-1}$) |
|---|---|---|---|---|
| Example 3-1 | Hydrogen 60%/Ammonia 40% | 573 K, 2 h | 0.27 | −1.18 |
| Example 3-2 | Hydrogen 60%/Ammonia 40% | 623 K, 1 h | 0.21 | −2.57 |
| Example 3-3 | Hydrogen 60%/Ammonia 40% | 623 K, 2 h | 0.22 | −2.33 |

TABLE 6-continued

| | Reactance gas | Heat Treatment Condition | Half Width (degrees) | Maximum Inclination ($Am^2kg^{-1}K^{-1}$) |
|---|---|---|---|---|
| Example 3-4 | Hydrogen 60%/Ammonia 40% | 623 K, 4 h | 0.25 | −2.13 |
| Example 3-5 | Hydrogen 60%/Ammonia 40% | 673 K, 2 h | 0.36 | −1.57 |
| Example 3-6 | Hydrogen 60%/Ammonia 40% | 673 K, 3 h | 0.42 | −1.05 |
| Comparative Example 3-3 | Hydrogen 60%/Ammonia 40% | 723 K, 3 h | 0.54 | −0.65 |

Embodiment 4

An ingot having a weight of 10 kg and composed of 17.1 mass % (7.2 atomic %) of La, 5.3 mass % (11.1 atomic %) of Si, and the balance being substantially Fe was obtained by melting Fe, Si and La by high frequency melting and by quenching a molten metal thereof from 1650 K. The ingot was a ferromagnetic body composed of (Fe—Si) phase and two La-rich phases and having the composition formula of $La(Fe_{0.88}Si_{0.12})_{12.8}$. The alloy was subjected to solution heat treatment in an argon atmosphere at 1323 K for 250 hours to be made a single phase of $NaZn_{13}$ and then pulverized to not more than 500 μm with a disc mill. 1 kg of powder was subjected to heat treatment at 623 K in a mixed reactant gas of 1 atmospheric pressure for one hour with the ratio of hydrogen and ammonia varied. Results shown in FIG. 9 were obtained in examining the relationship between an amount of hydrogen and that of nitrogen of powder after heat treatment. It is found that Curie temperatures vary linearly in the range of 260 to 310 K relative to the sum (atomic %) of hydrogen and nitrogen. It is found that half-widths of diffraction lines of the (531) plane as measured by X-ray diffraction are all not more than 0.30 degrees as shown in FIG. 8 and homogeneous alloys having a constant lattice constant are obtained. FIGS. 10 and 11 show magnetization-temperature diagrams of alloys having different concentrations of ammonia at the time of heat treatment. It is found that magnetization-temperature curves have those maximum inclinations of changes in magnetization in the vicinity of Curie temperatures, which are all larger than −2 $Am^2/K$ and alloys being very magnetically homogeneous are formed. Results are put in order and indicated in TABLES 7 and 8.

TABLE 7

| | Reactance gas | Heat Treatment Condition | Amount of Hydrogen (at %) | Amount of Nitrogen (at %) | N + H (at %) | Curie temperature (K) |
|---|---|---|---|---|---|---|
| Example 4-1 | Ammonia 100% | 623 K, 1 h | 2.08 | 0.73 | 2.81 | 233.8 |
| Example 4-2 | Hydrogen 10%/Ammonia 90% | " | 6.68 | 0.80 | 7.48 | 260.1 |
| Example 4-3 | Hydrogen 20%/Ammonia 80% | " | 8.47 | 0.43 | 8.90 | 270.4 |
| Example 4-4 | Hydrogen 30%/Ammonia 70% | " | 8.97 | 0.69 | 9.67 | 278.2 |
| Example 4-5 | Hydrogen 40%/Ammonia 60% | " | 9.76 | 0.79 | 10.55 | 281.1 |
| Example 4-6 | Hydrogen 50%/Ammonia 50% | " | 11.13 | 0.68 | 11.80 | 289.2 |
| Example 4-7 | Hydrogen 60%/Ammonia 40% | " | 11.84 | 0.71 | 12.56 | 301.0 |
| Example 4-8 | Hydrogen 70%/Ammonia 30% | " | 13.42 | 0.76 | 14.18 | 304.6 |
| Example 4-9 | Hydrogen 90%/Ammonia 10% | " | 14.57 | 0.41 | 14.98 | 310.6 |

TABLE 8

| | Reactance gas | Heat Treatment Condition | Half Width (degrees) | Maximum Inclination ($Am^2kg^{-1}K^{-1}$) |
|---|---|---|---|---|
| Example 4-1 | Ammonia 100% | 623 K, 1 h | 0.20 | −2.38 |
| Example 4-2 | Hydrogen 10%/Ammonia 90% | " | 0.25 | −2.06 |
| Example 4-3 | Hydrogen 20%/Ammonia 80% | " | 0.25 | −2.46 |
| Example 4-4 | Hydrogen 30%/Ammonia 70% | " | 0.29 | −2.33 |
| Example 4-5 | Hydrogen 30%/Ammonia 70% | " | 0.21 | −2.03 |
| Example 4-6 | Hydrogen 50%/Ammonia 50% | " | 0.27 | −2.13 |
| Example 4-7 | Hydrogen 60%/Ammonia 40% | " | 0.29 | −2.27 |
| Example 4-8 | Hydrogen 70%/Ammonia 30% | " | 0.28 | −2.05 |

TABLE 8-continued

| | Reactance gas | Heat Treatment Condition | Half Width (degrees) | Maximum Inclination ($Am^2kg^{-1}K^{-1}$) |
|---|---|---|---|---|
| Example 4-9 | Hydrogen 90%/Ammonia 10% | " | 0.31 | −1.45 |

INDUSTRIAL APPLICABILITY

Magnetic powder according to the invention can be applied to refrigerating and air-conditioning equipment, in which chlorofluorocarbon gas is not used as a magnetic, refrigerating material, and made use of in a highly efficient, refrigerating system, which realizes refrigerating machines, air-conditioners, etc., which are free of environmental disruption.

Figure 1:
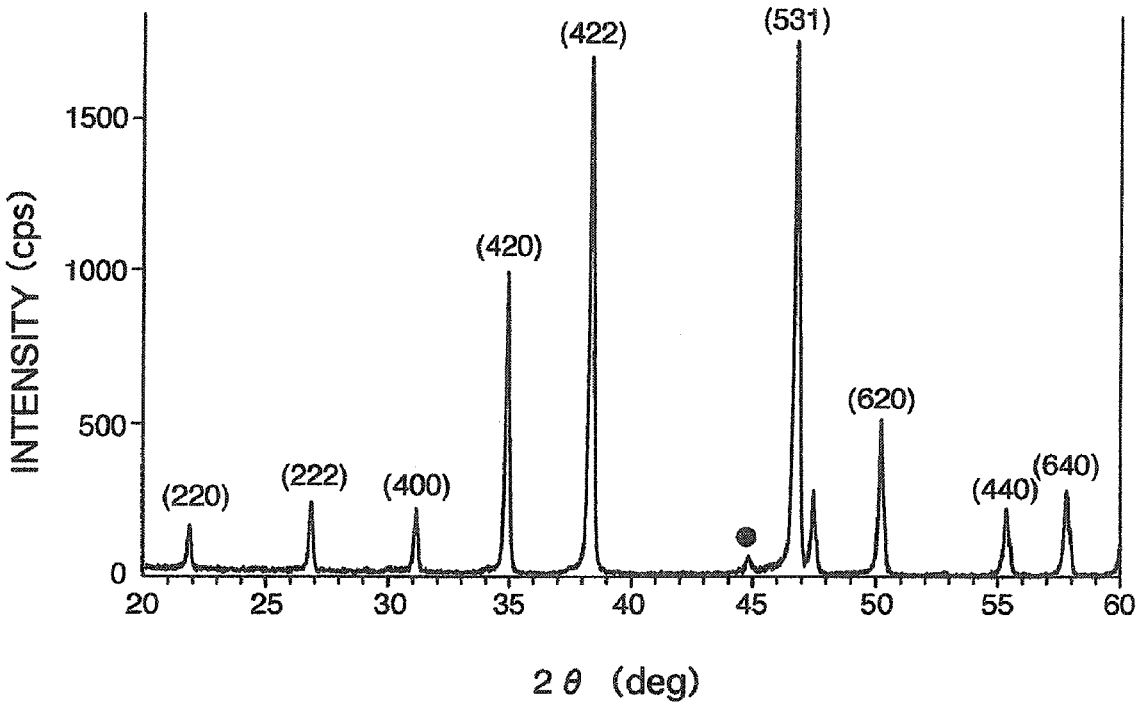
FIG. 1 shows a X-ray diffraction diagram of magnetic powder according to the invention.
Figure 2:
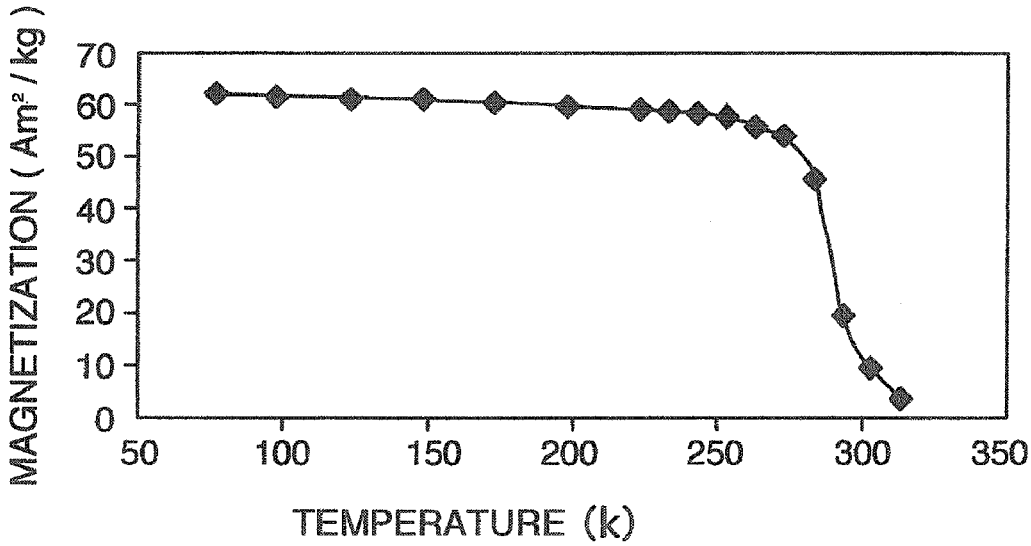
FIG. 2 shows a magnetization-temperature diagram of the magnetic powder (reactant gas being 60% of hydrogen and 40% of ammonia and condition of heat treatment being at 623K for 1 hour) according to the invention.
Figure 3:
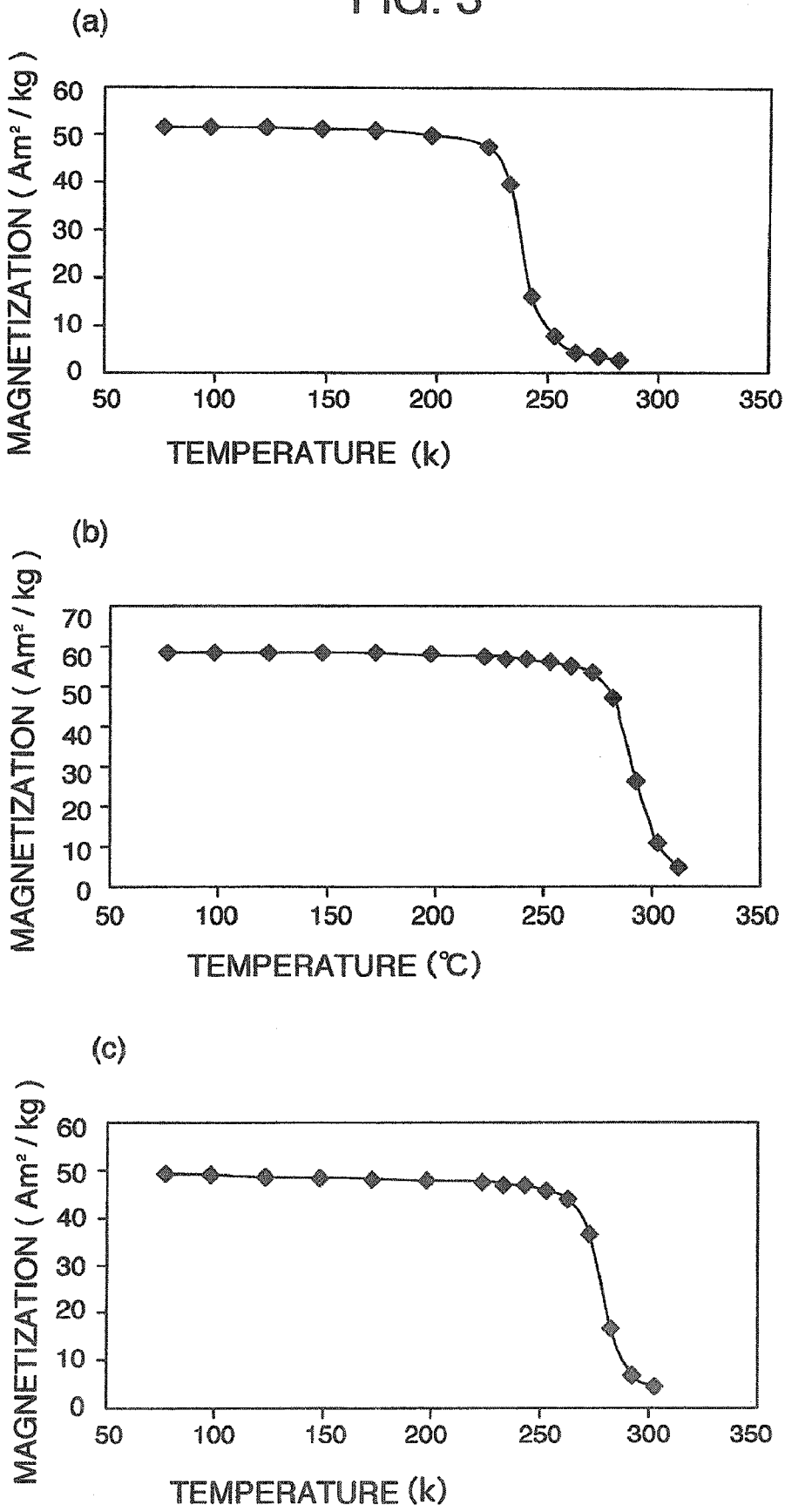
FIGS. 3(*a*) to (*c*) show magnetization-temperature curves of the magnetic powder according to the invention, FIG. 3(*a*): reactant gas being 100% of ammonia and heat treatment at 623 K for 1 hour), FIG. 3(*b*): reactant gas being 70% of hydrogen and 30% of ammonia and heat treatment at 533 K for 1 hour), and FIG. 3(*c*): reactant gas being 40% of hydrogen and 60% of ammonia and heat treatment at 533 K for 1 hour.
Figure 4:
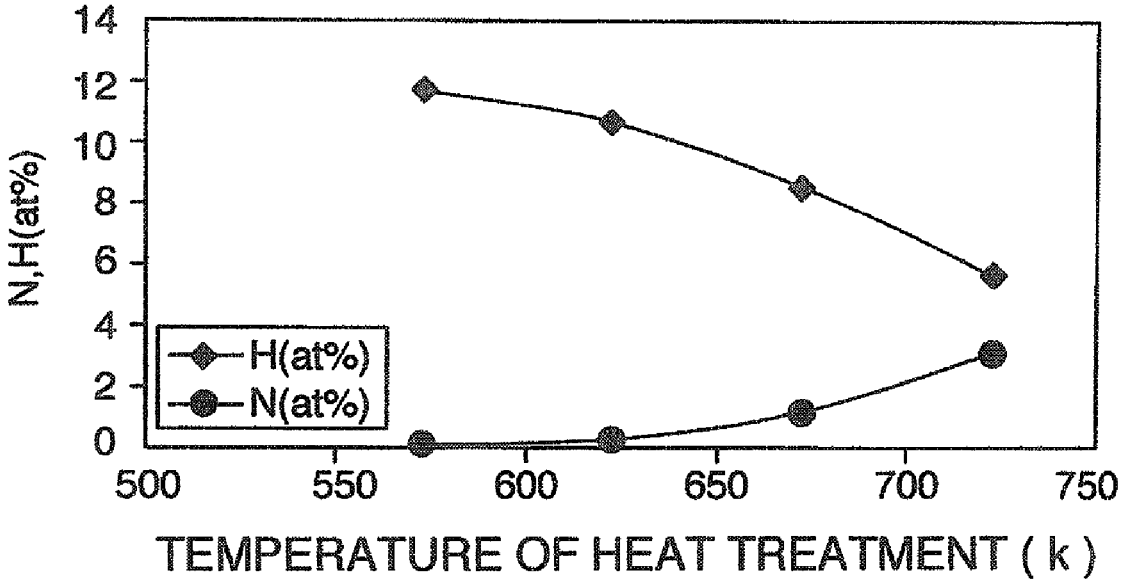
FIG. 4 is a view illustrating the relationship between heat treatment temperatures and amounts of solute hydrogen and nitrogen according to the invention.
Figure 5:
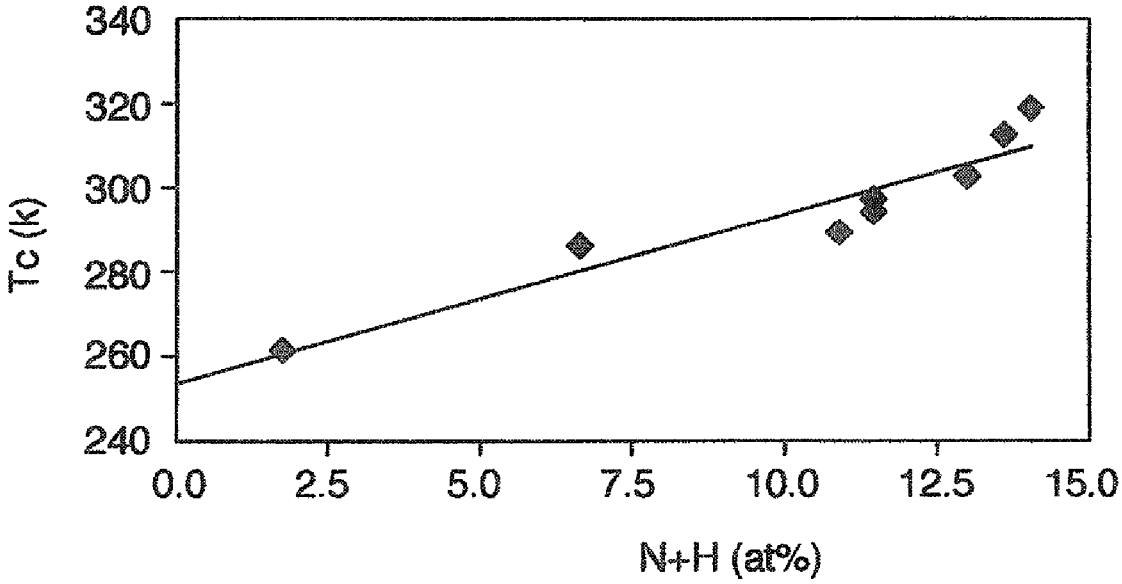
FIG. 5 is a view illustrating the relationship between a Curie temperature and the sum of hydrogen and nitrogen according to the invention.
Figure 6:
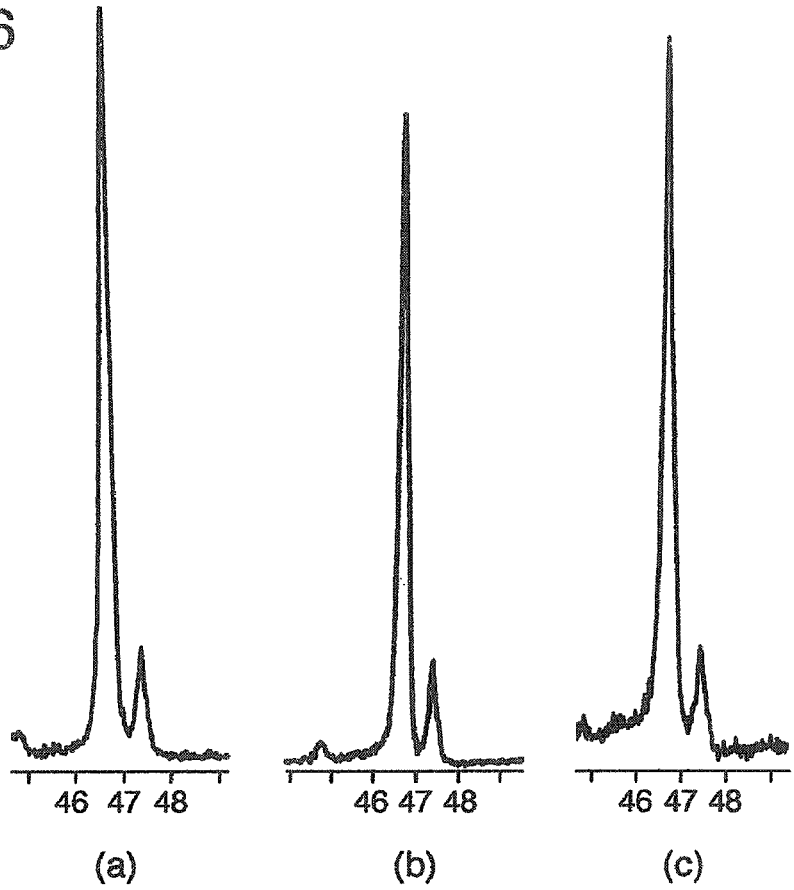
FIGS. 6(*a*) to (*c*) show X-ray diffraction diagrams of the magnetic powder according to the invention (FIG. 6(*a*) being for Example 3-1, FIG. 6(*b*) being for Example 3-2, and FIG. 6(*c*) being for Example 3-4)
Figure 7:
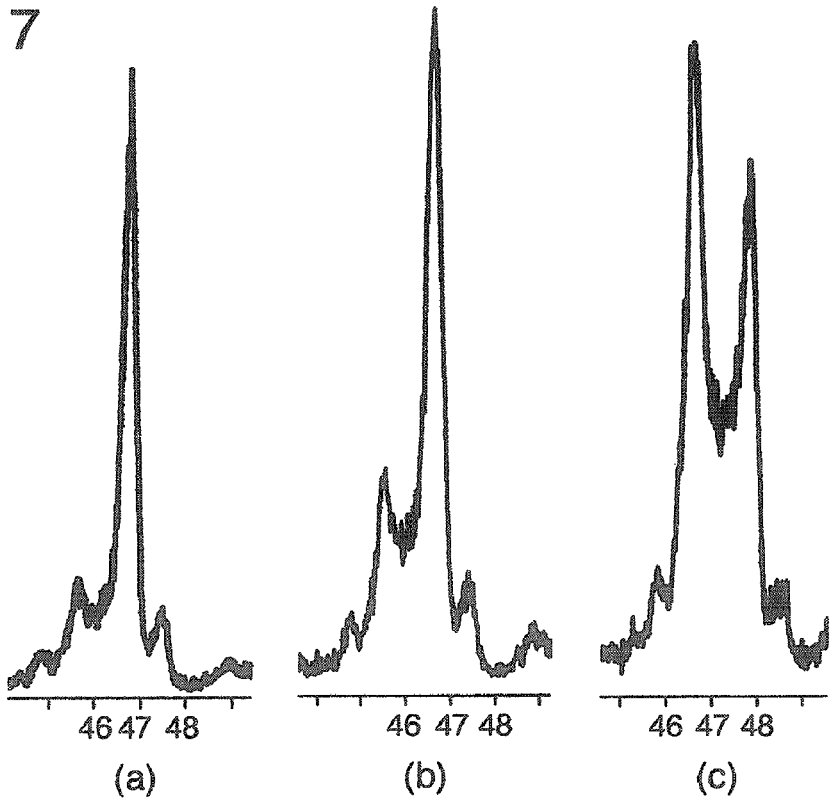
FIGS. 7(*a*) to (*c*) shows X-ray diffraction diagrams of Examples and a Comparative example (FIG. 7(*a*) being for Example 3-5, FIG. 7(*b*) being for Example 3-6, and FIG. 7(*c*) being for Comparative example 3-4)
Figure 8:
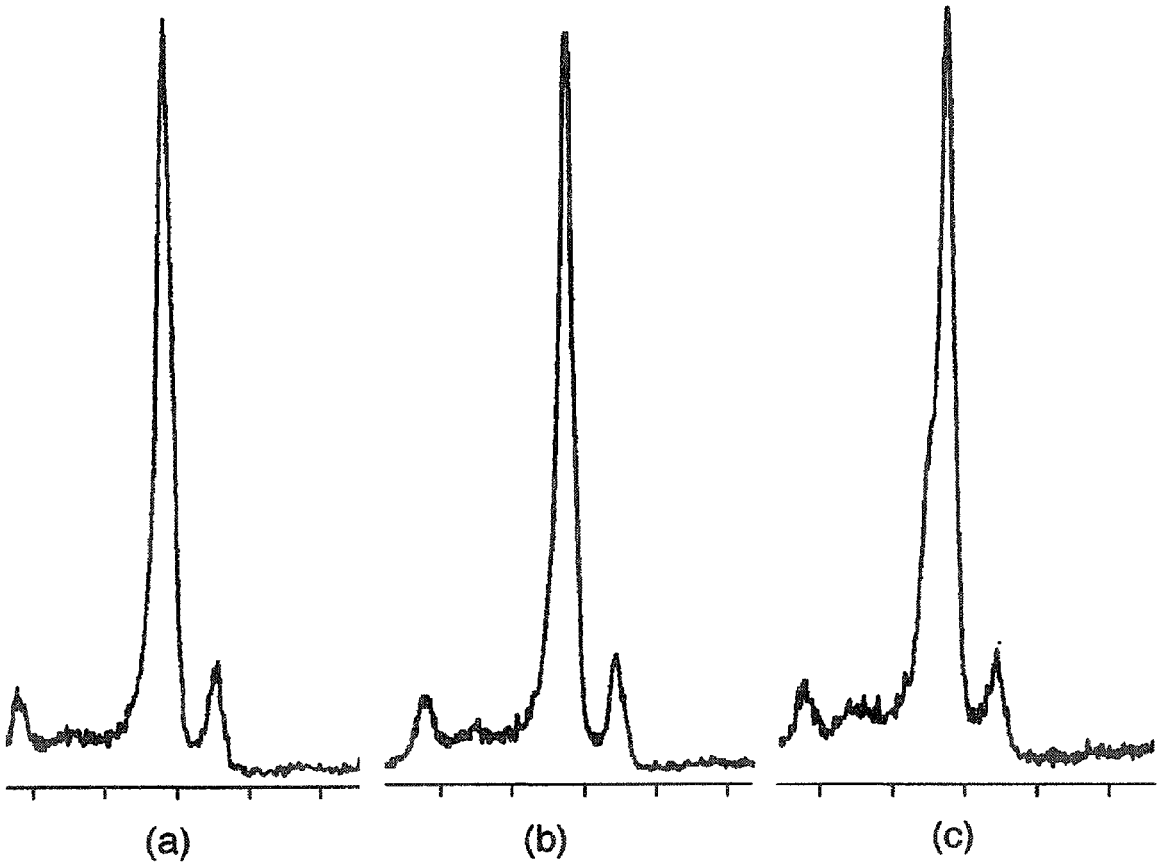
FIGS. 8(*a*) to (*c*) show X-ray diffraction diagrams of the magnetic powder according to the invention (FIG. 8(*a*) being for Examples 4-9, FIG. 8(*b*) being for Examples 4-8, and FIG. 8(*c*) being for Examples 4-6)
Figure 9:
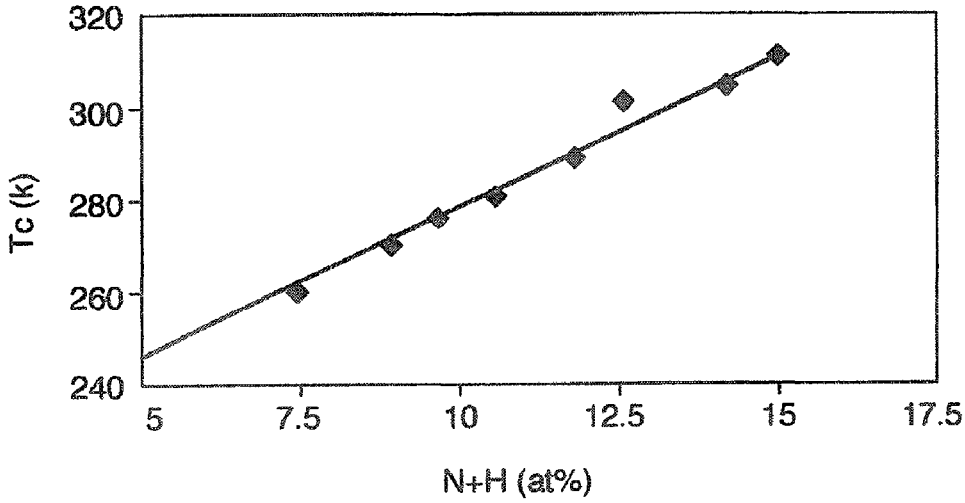
FIG. 9 is a view illustrating the relationship between a Curie temperature and the sum of hydrogen and nitrogen according to the invention.
Figure 10:
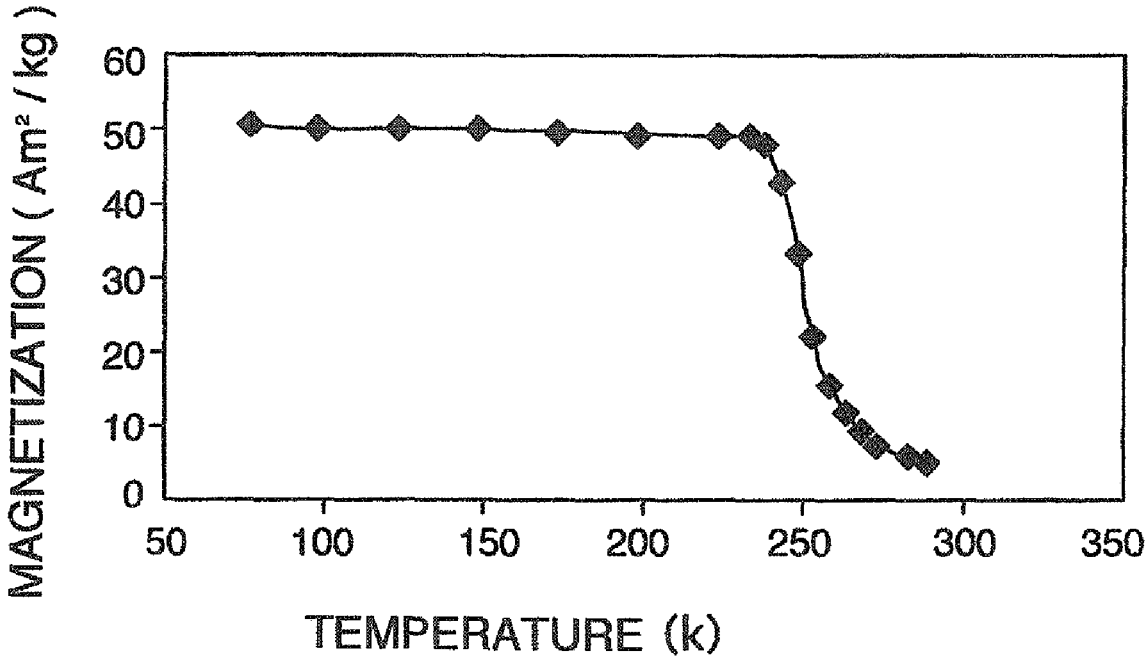
FIG. 10 is a view showing a magnetization-temperature diagram of the magnetic powder according to the invention (reactant gas: 10% of hydrogen and 90% of ammonia, and condition of heat treatment at 623 K for 1 hour)
Figure 11:
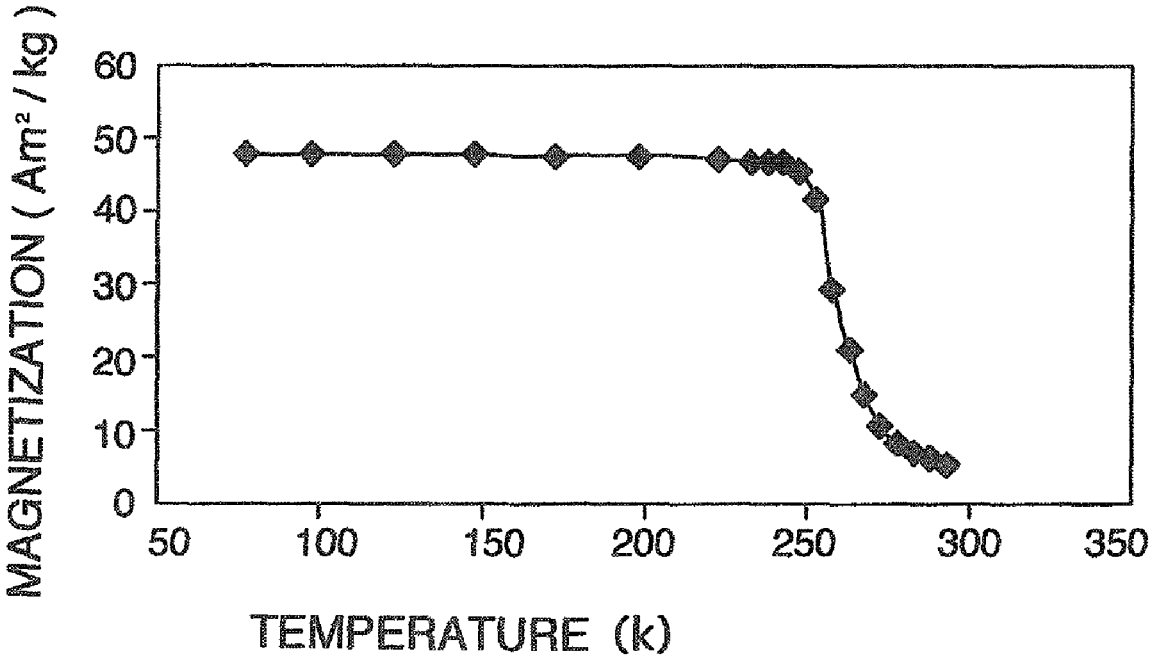
FIG. 11 is a view showing a magnetization-temperature diagram of the magnetic powder according to the invention (reactant gas: 20% of hydrogen and 80% of ammonia and condition of heat treatment at 623 K for 1 hour)
Figure 12:
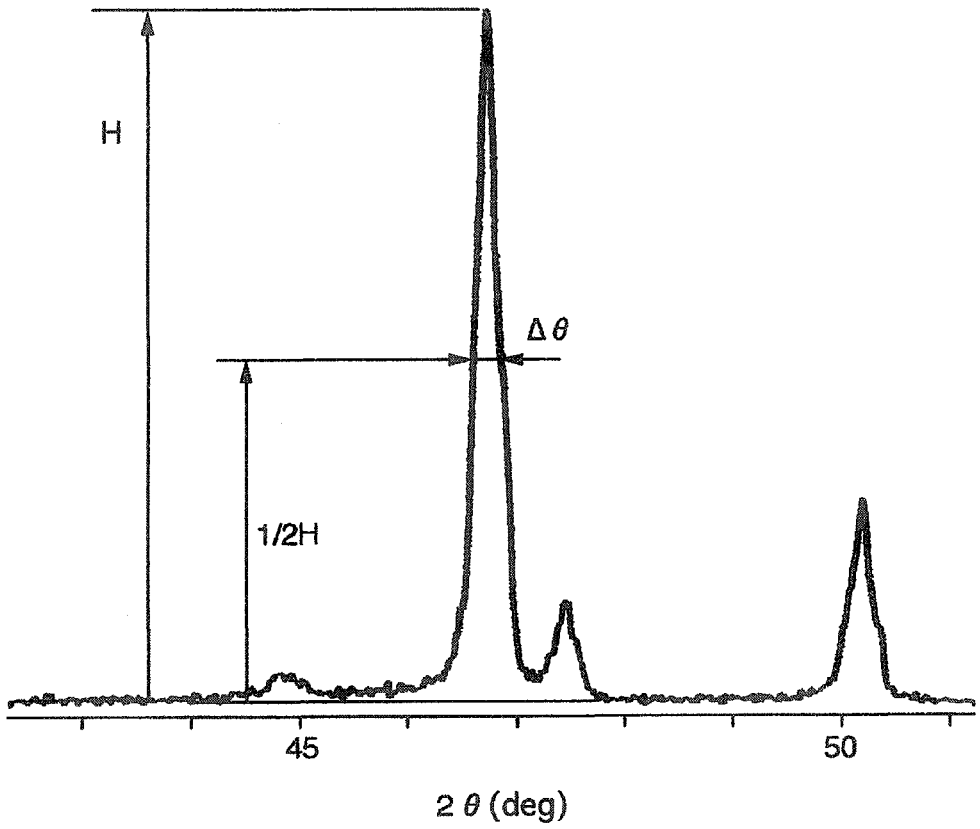
FIG. 12 is a view illustrating a half-width in a X-ray diffraction diagram.
Figure 13:
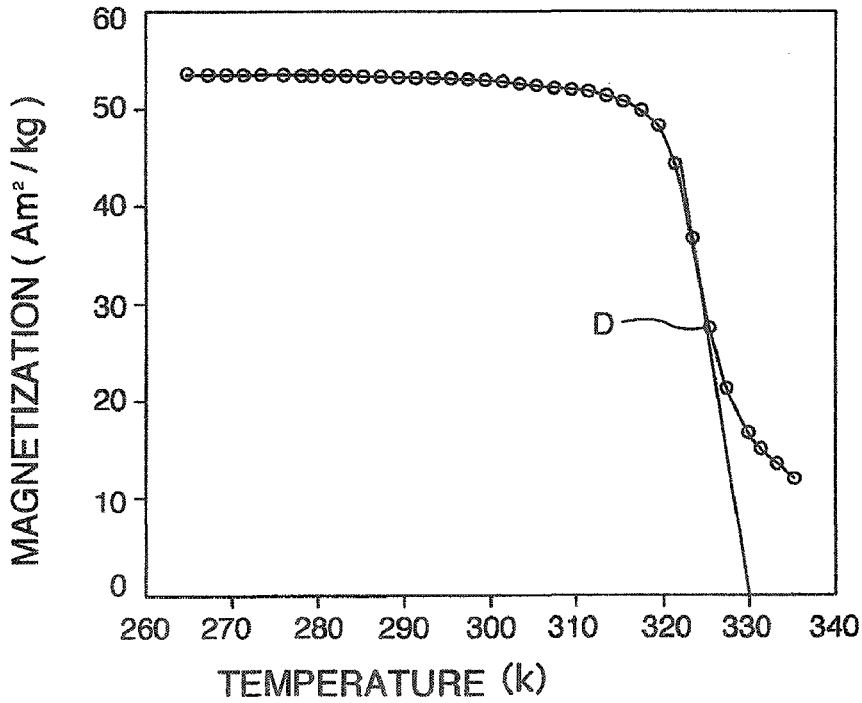
FIG. 13 is a view illustrating a maximum inclination in a magnetization-temperature diagram.
Figure 14:
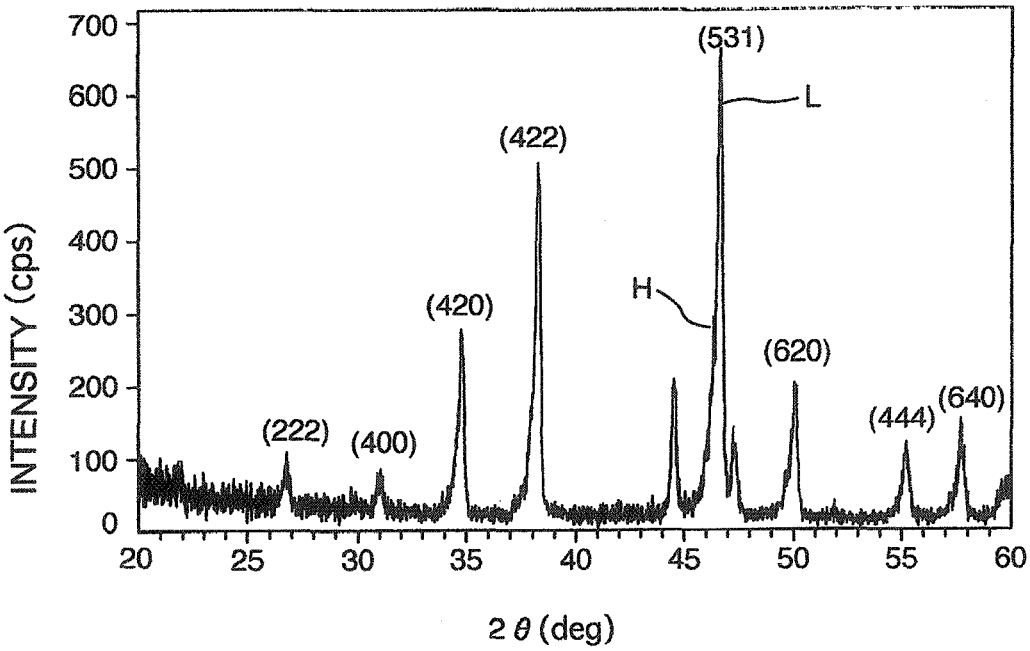
FIG. 14 is a X-ray diffraction diagram of a comparative example, "H" indicating a phase having much absorbed hydrogen and "L" indicating a phase having less absorbed hydrogen.
Figure 15:
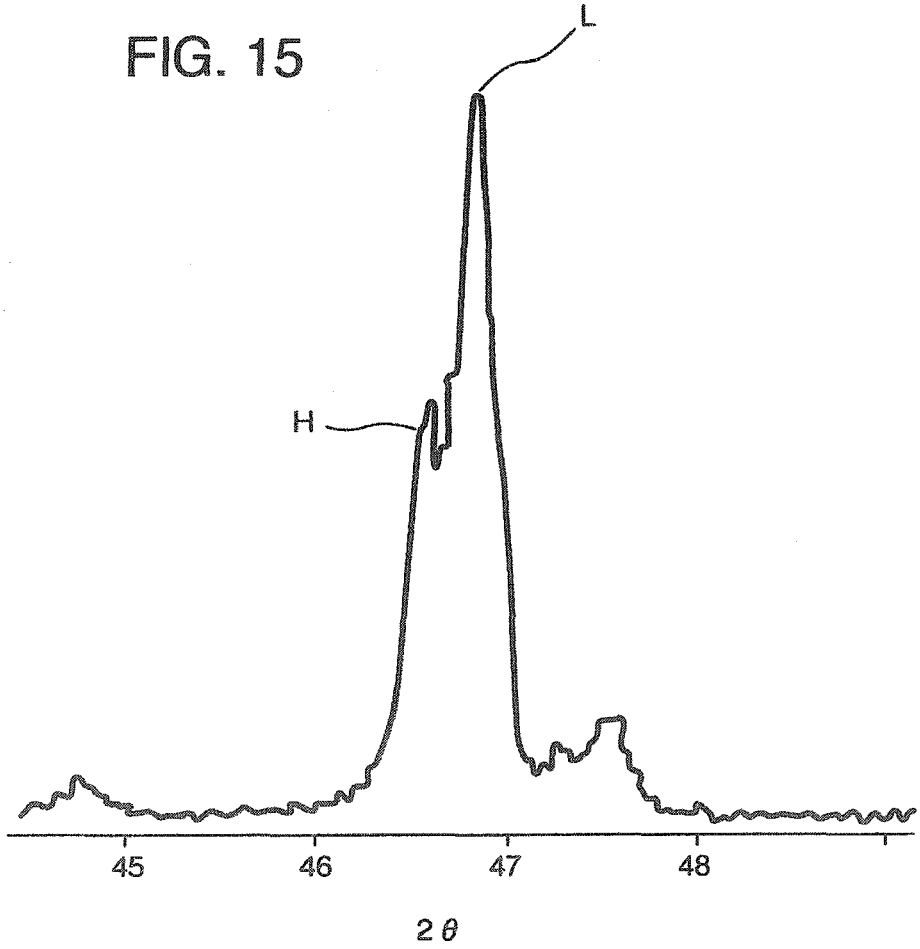
FIG. 15 is a partially enlarged view of FIG. 14.
Figure 16:
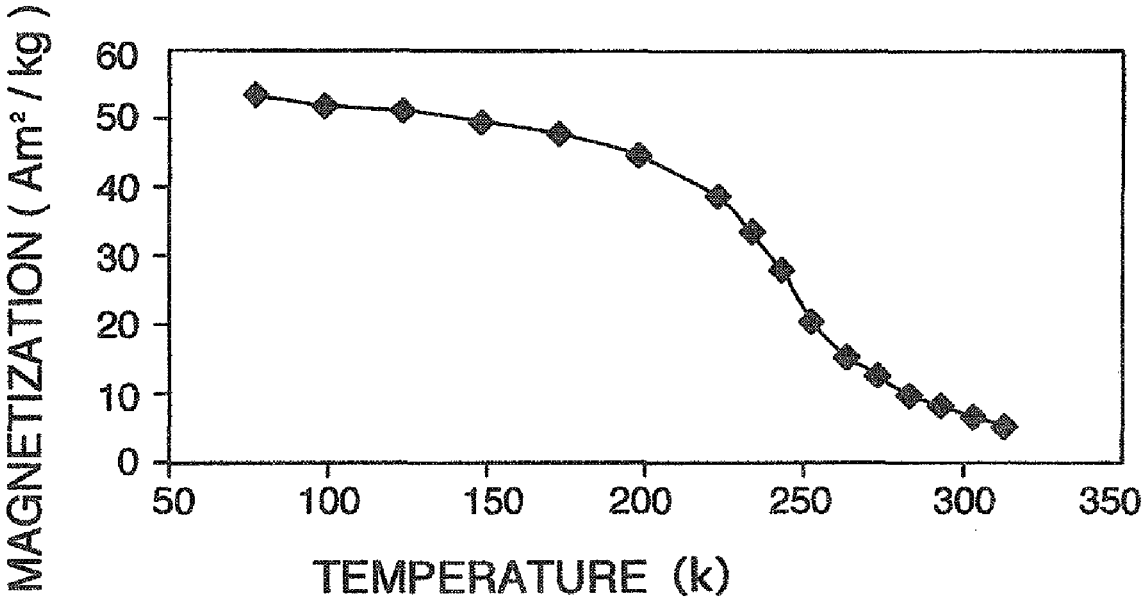
FIGS. 16(*a*) and (*b*) show changes in magnetization-temperature for comparative examples, FIG. 16(*a*) being for condition of heat treatment at 533K for 0.5 hours, and FIG. 16(*b*) being for condition of heat treatment at 533K at 1 hour.
Figure 16:
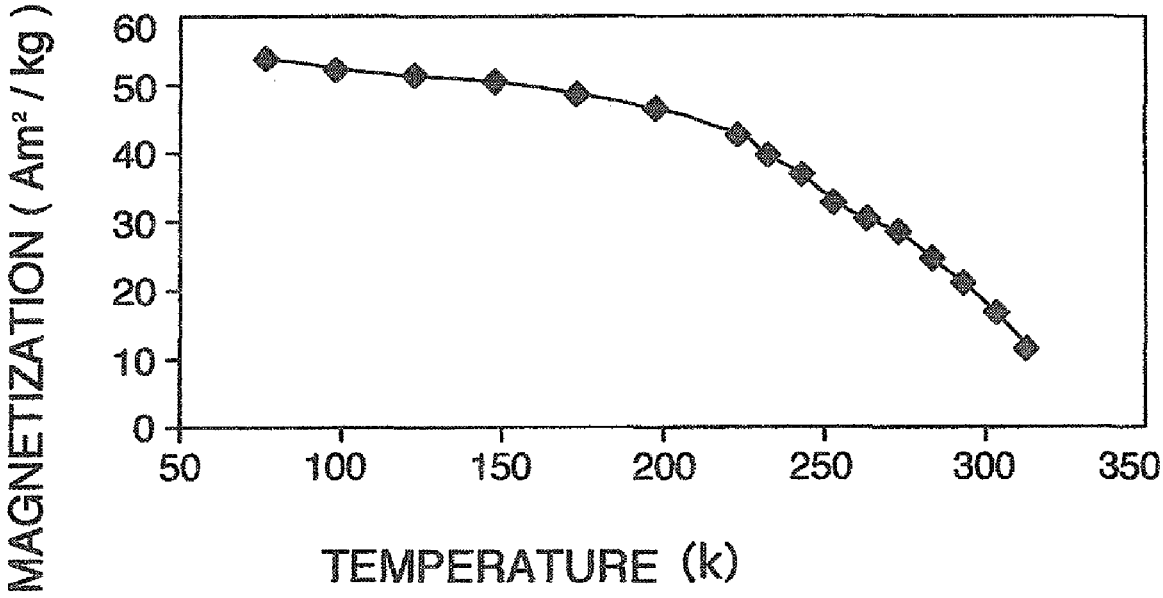

The invention claimed is:

1. A magnetic alloy having a crystal structure substantially composed of a single phase of $NaZn_{13}$ structure and represented by the composition formula $(La_{1-x}R_x)_a(A_{1-y}TM_y)_bH_cN_d$, wherein "R" represents at least one or more elements selected from rare earth elements including Y; "A" represents Si, or Si and at least one or more elements selected from the group consisting of Al, Ga, Ge and Sn; "TM" represents Fe, or Fe and at least one or more elements selected from the group consisting of Sc, Ti, V, Cr, Mn, Co, Ni, Cu and Zn; and "x", "y", "a", "b", "c" and "d" satisfy, in atomic percent, the relations: $0 \leqq x \leqq 0.2$, $0.75 \leqq y \leqq 0.92$, $5.5 \leqq a \leqq 7.5$, $73 \leqq b \leqq 85$, $1.3 \leqq c \leqq 14.57$ and $0.08 \leqq d \leqq 3.0$; with unavoidable impurities being included.

2. The magnetic alloy according to claim 1, wherein a diffraction line corresponding to a (531) plane of the phase of $NaZn_{13}$ structure in X-ray diffraction, in which Cu is targeted, has a half-width of not more than 0.3 degrees by radian.

3. The magnetic alloy according to claim 1, wherein the magnetic alloy has a Curie temperature being 245 to 330 K and a maximum inclination of a magnetization-temperature curve measured in an applied field of 1 kOe, due to magnetic transformation, being not more than $-1\ Am^2kg^{-1}K^{-1}$.

4. The magnetic alloy according to claim 1, wherein the magnetic alloy is in a form of powder having a particle size of not more than 500 μm.

5. A method for manufacturing the magnetic alloy as claimed in claim 1, in which a $((La \cdot R)-(A \cdot TM)_{13})$ based alloy is subjected to heat treatment at 550 to 700 K in a reactant gas including nitrogen and hydrogen, wherein "R"represents at least one or more elements selected from rare earth elements including Y; "A"represents Si, or Si and at least one or more elements selected from the group consisting of Al, Ga, Ge and Sn; and "TM" represents Fe, or Fe and at least one or more elements selected from the group consisting of Sc, Ti, V, Cr, Mn, Co, Ni, Cu and Zn; and the alloy includes unavoidable impurities.

6. The method according to claim 5, wherein heat treatment is performed for 0.5 to 5 hours.

7. The method according to claim 5, wherein the reactant gas is a mixed gas of hydrogen and nitrogen, a mixed gas of hydrogen and ammonia, or ammonia gas.

* * * * *